United States Patent [19]

Bailey et al.

[11] Patent Number: 4,759,413

[45] Date of Patent: Jul. 26, 1988

[54] METHOD AND APPARATUS FOR SETTING AN UNDERWATER DRILLING SYSTEM

[75] Inventors: Thomas F. Bailey; John E. Campbell, both of Houston, Tex.

[73] Assignee: Drilex Systems, Inc., Houston, Tex.

[21] Appl. No.: 37,818

[22] Filed: Apr. 13, 1987

[51] Int. Cl.[4] ..... E21B 7/128; E21B 7/20

[52] U.S. Cl. ..... 175/6; 175/7; 175/171; 175/258; 175/320

[58] Field of Search ..... 175/6, 7, 171, 257, 175/258, 320, 321; 166/339, 340, 348, 358; 405/223, 227, 236, 240–243

[56] References Cited

U.S. PATENT DOCUMENTS

| | | | |
|---|---|---|---|
| 3,360,048 | 12/1967 | Watkins | 166/87 |
| 3,519,071 | 7/1970 | Word, Jr. | 175/171 X |
| 3,621,910 | 11/1971 | Sanford et al. | 175/171 X |
| 3,628,604 | 12/1971 | Childers et al. | 166/75 X |
| 3,732,143 | 5/1973 | Joosse | 175/6 |
| 3,782,460 | 1/1974 | Skinner | 175/7 X |
| 3,901,331 | 8/1975 | Djurovic | 175/171 |
| 4,133,396 | 1/1979 | Tschirky | 175/171 X |
| 4,216,835 | 8/1980 | Nelson | 175/10 |
| 4,474,243 | 10/1984 | Gaines | 175/171 X |
| 4,508,167 | 4/1985 | Weinberg et al. | 166/120 |
| 4,593,937 | 6/1986 | Schawann et al. | 285/920 X |

FOREIGN PATENT DOCUMENTS

| | | | |
|---|---|---|---|
| 876946 | 10/1981 | U.S.S.R. | 175/6 |

*Primary Examiner*—Stephen J. Novosad

*Assistant Examiner*—Hoang C. Dang

*Attorney, Agent, or Firm*—Edgar A. Zarins; Malcolm L. Sutherland; Leon E. Redman

[57] ABSTRACT

A method and apparatus for setting an underwater conductor pipe in which the conductor pipe is lowered into the wellhole on a drill string as the borehole is being formed by a drill bit and underreamer positioned at the end of the drill string below the end of the conductor pipe. The drill string and conductor pipe are detachably interconnected by a housing latch which includes means for detachably securing the drill string and drilling assembly to the conductor pipe. The drill string is provided with an upper latch sub, which retains and supports the drill string in its fully extended position within the conductor pipe, and a lower latch sub which retains and supports the drill string in the retracted position. As the apparatus is lowered a drill motor actuates the drilling assembly such that the well hole is formed in the ocean floor. Drilling continues until the permanent guide base of the conductor pipe engages the ocean floor. Thereafter, the upper latch sub is released and the drill string is retracted until the lower latch engages the latchhousing. The outer annulus of the conductor pipe is then cemented into place while pressure within the conductor pipe is maintained to prevent the cement from travelling up the inside of the conductor pipe. Once the cement is set, the latchhousing is released so that the drill string and latchhousing can be removed from the conductor pipe.

20 Claims, 4 Drawing Sheets

METHOD AND APPARATUS FOR SETTING AN UNDERWATER DRILLING SYSTEM

BACKGROUND OF THE INVENTION

I. Field of the Invention

This invention relates to a system for setting a conductor pipe assembly in a hole formed in the ocean floor and, in particular, to a method and apparatus for lowering the assembly on a drill string, moving the structure into the hole as it is drilled by the drill string, cementing the structure in the hole, and recovering the drill string.

II. Description of the Prior Art

Underwater exploration and drilling for gas and oil deposits has become increasingly necessary in order to meet rising demands. It has been found that large deposits lie beneath the ocean floors. However, because of current and weather conditions associated with such exploration it is necessary to provide a quick and simple way of setting a conductor pipe assembly from a floating barge or vessel. Until recently, the initial conductor pipe assembly was either jetted into place or driven into the formation. This was possible because of the relatively soft formations, such as sand, within which such wells were drilled. More recently, the formations have been found to be hard enough to require a one-trip, drilled-in conductor pipe system.

One such system is described in U.S. Pat. No. 3,621,910 directed to a method and apparatus for setting an underwater structure. The system described therein requires rotation of the entire drill string in order to commence drilling. In addition, rotation of the drill string is needed in order to latch and unlatch the drill string from the wellhead housing. As a result, the wellhead housing is caused to twist or rotate thereby twisting and tangling the guide lines and hydraulic hoses. Furthermore, this system provided insufficient retraction of the drill string thereby resulting in junking of the well hole in the event the cement inadvertently travels up the interior passageway of the conductor pipe.

SUMMARY OF THE PRESENT INVENTION

The present invention overcomes the disadvantages of the prior known systems for setting an underwater conductor pipe by providing a system which is capable of one-trip, drilled-in placement of the conductor pipe.

The present invention includes a drill string which is supported within a conductor pipe by way of a housing latch detachably secured to the wellhead housing which forms a portion of the permanent guide base of the structure. The bottom end of the drill string includes a drill bit and underreamer which extend below the end of the conductor pipe so as to allow efficient drilling of the well hole. A high torque mud motor located just above the underreamer is used for rotation of the bit and underreamer while the remainder of the drill string is stationary. Stabilizers are also provided in the drill string.

The drill string further includes upper and lower latch subs which support and retain the drill string in the extended and retracted positions, respectively. The upper latch has an annular shoulder which engages the latchhousing and supports the weight of the drill string. In addition, a series of retractable pins engage annular grooves formed in the latch sub to maintain the position of the drill string relative to the wellhead housing during the drilling operation. Similarly, the lower latch sub includes an annular shoulder adapted to engage the bottom of the latchhousing and annular grooves to engage the retractable pins. Moreover, the lower latch sub is provided with a series of spring-biased dogs having an upper sloped surface which facilitate retraction of the dogs such that they may pass beneath the latchhousing during retraction of the drill string. However, as the annular shoulder of the latch engages the latchhousing thereby preventing further retraction of the drill string, the dogs will be biased outwardly to act as shoulders for support of the drill string in the retracted position.

In addition to preventing vertical movement of the drill string, the latchhousing detachably secures the drilling assembly to the conductor pipe such that once the pipe is set, the assembly can be retrieved therefrom. Normally, the latchhousing merely rests within the wellhead housing of the conductor pipe. However, in order to prevent a loss of pressure within the conductor pipe during cementation, retractable outer pins are utilized to retain the latchhousing within the wellhead. Both the inner and outer sets of pins are controlled by pistons which are hydraulically movable from a first position in which the pins are freely retractable, to a second position in which the pins are prevented from retracting from the corresponding grooves. In addition, means are provided for manually moving the pistons in the event the hydraulic system fails.

The method of the present invention utilizes the above-described system to set the conductor pipe. The conductor pipe and drill string are mounted to a permanent guide base which is lowered from a vessel located at the surface. As the system nears the ocean floor, the mud motor is actuated to initiate drilling. Since the drill bit and underreamer extend beneath the end of the conductor pipe, the pipe will be free to travel into the hole without requiring any additional driving force. Drilling continues until the guide base contacts the ocean floor whereupon the drill string is partially retracted by disengaging the inner pins of the latchhousing to allow vertical movement of the string. When the lower latch sub reaches the latchhousing the spring-biased dogs are forced inwardly until the annular shoulder engages the latchhousing at which time the dogs once again extend outwardly to support the drill string within the wellhead housing.

With the drilling equipment retracted, cementation can begin in order to permanently set the conductor pipe. As cement is pumped through the outer annulus of the wellhole, a predetermined pressure is maintained within the conductor pipe to prevent the cement from travelling up the inner passageway of the conductor pipe or U-tubing. In the event this pressure blows-out causing U-tubing the cement will not engulf the drilling equipment since the amount of cement is not sufficient to reach past the retracted position of the drill string. Upon successful cementation of the conductor pipe, the drill string and housing latch are retrieved by first retracting the outer pins of the housing latch such that the assembly can be removed from the conductor pipe.

Thus, the present invention provides a simple yet failsafe method and apparatus for setting a conductor pipe for a well which requires only one-trip while preventing junking of the well hole in the event of a pressure blow-out.

Other objects, features and advantages of the invention will be apparent from the following detailed description taken in connection with the accompanying drawings.

BRIEF DESCRIPTION OF THE DRAWINGS

The present invention will be more fully understood by reference to the following detailed description of a preferred embodiment of the present invention when read in conjunction with the accompanying drawings, in which like reference characters refer to like parts throughout the views and in which.

DETAILED DESCRIPTION OF A PREFERRED EMBODIMENT OF THE PRESENT INVENTION

Figure 1:
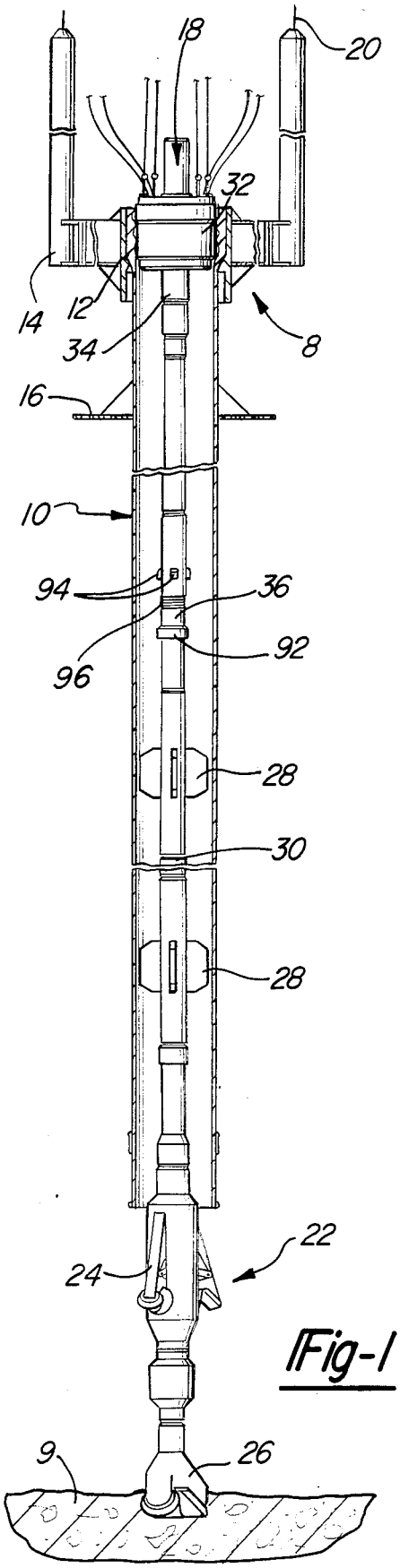
FIG. 1 is an elevation view of a conductor pipe assembly and guide base being lowered in the water and ready to drill.

FIGS. 1 through 4 illustrate the method of the present invention for setting an underwater conductor pipe drilling system 8 in the floor 9 of the ocean or similar body of water. The assembly 8 includes a tubular conductor pipe 10 having a wellhead housing 12 formed at or connected to the upper end of the conductor pipe 10. Secured to the outer periphery of the wellhead housing 12 is a permanent guide base 14 which includes an optional foot pad 16 to position the conductor pipe assembly 8. The conductor pipe assembly 8 is substantially supported on the drill string 18 and is lowered into the water from a surface vessel (not shown). However, additional support and guidance of the conductor pipe assembly 8 is provided through guidelines 20 which extend from the guide base 14 to the surface vessel.

The preferred embodiment of the drill string 18 comprises a plurality of tubular sections including conventional drill collars, crossover subs, bumper subs, etc. Disposed at the lower end of the drill string 18 is a drill portion 22 which includes an underreamer 24 and a drill bit 26. In the preferred embodiment, both the underreamer 24 and the drill bit 26 extend below the lower end of the conductor pipe 10 in order to facilitate drilling of the well hole as the assembly is lowered into the hole. The drill string 18 also includes at least one stabilizer 28 which prevents the drill string 18 from swaying within the conductor pipe 10 as a result of the rotational torque. The drill portion 22 of the drill string 18 is rotatively driven by a high torque mud motor 30 (partially shown) disposed within the drill string 18 preferably between a pair of the stabilizers 28. By utilizing the mud motor 30 in the drill string 18, the lower portion of the drill string 18 is rotated in order to drive the drill bit 26 and underreamer 24 while the portion of the drill string 18 above the high torque mud motor 30 remains stationary thereby eliminating rotation and tangling of the guidelines 20 and associated hoses.

Referring still to FIGS. 1 through 4, the drill string 18 is detachably connected to the conductor pipe assembly 8 by a housing latch 32. The housing latch 32 preferably has a generally annular configuration with the drill string 18 passing through the center thereof. In turn, the housing latch 32 engages the wellhead housing 12 of the conductor pipe 10. The drill string 18 is adjustably connected to the housing latch 32 by way of an upper latch sub 34 and a lower latch sub 36 disposed within the drill string 18 in a spaced relationship. The operation of the housing latch 32 will be described in greater detail below.

Figure 2:
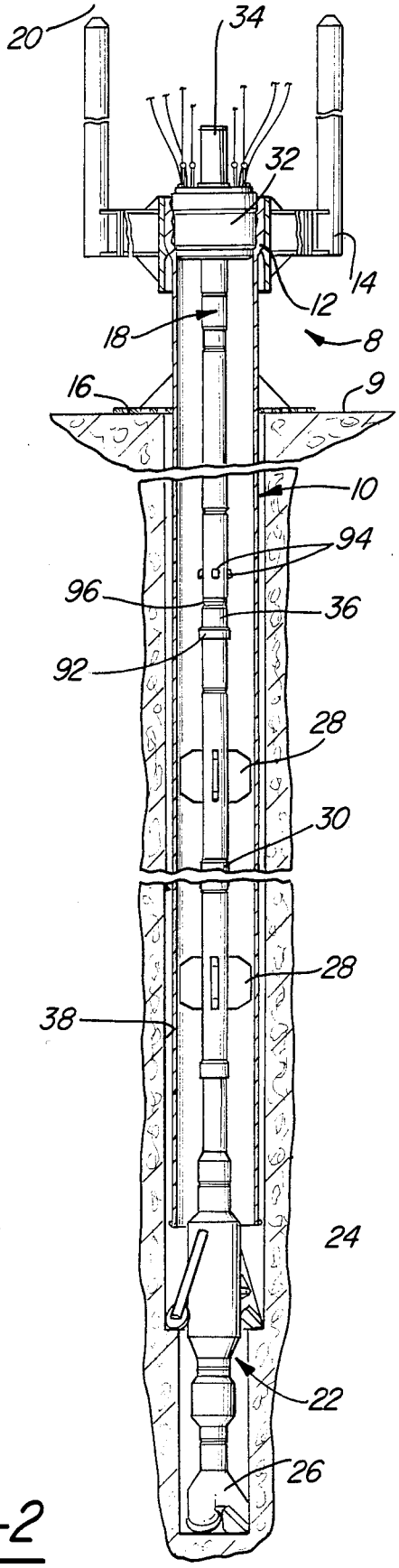
FIG. 2 is a similar view illustrating the drilling of the hole with the conductor pipe assembly moving into the hole and the guide base positioned on the ocean floor.

As the conductor pipe assembly 8 and the drill string 18 are lowered into the water, the high torque motor 30 will be activated to rotate the drill bit 26 and underreamer 24. Since both the underreamer 24 and drill bit 26 extend below the lower end of the conductor pipe 10, the underreamer 24 will operate in its expanded position in order to form the well hole 38 which is wider than the conductor pipe 10. As shown in FIG. 2, as the drilling progresses, the conductor pipe 10 is lowered into the bore hole 38 that is drilled as the drill string 18 is moved downward. The drilling is continued until the foot pad 16 engages the ocean floor 9. Alternatively, the foot pad 16 may be eliminated such that drilling continues until the guide base 14 engages the bottom.

Figure 3:
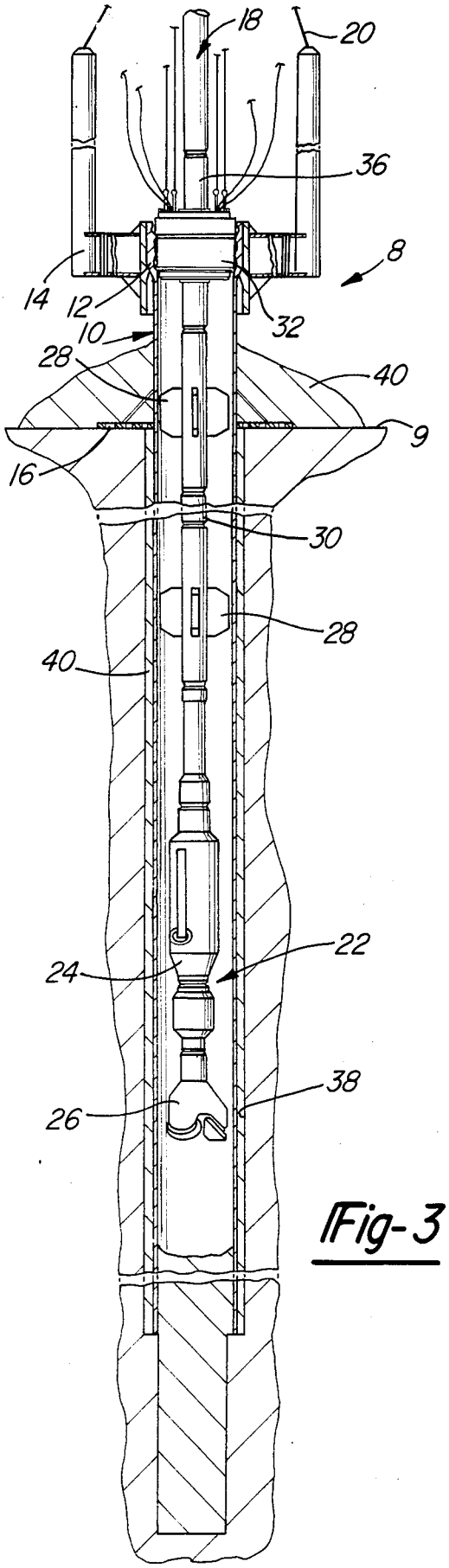
FIG. 3 is another similar view illustrating the position of the drill string with respect to the guide base during the cementing operation.

With the conductor pipe assembly 8 fully lowered as shown in FIG. 2, the assembly may be set by cementing the conductor pipe 10 within the borehole 38. However, before the cementation process can begin the drill string 18 must be moved from an extended position as shown in FIG. 2, to a retracted position as shown in FIG. 3. To accomplish this the housing latch 32 is disengaged from the upper latch sub 34 and the drill string 18 is drawn upwardly until the lower latch sub 36 engages the housing latch 32. In this position, the drill portion 22 of the string 18 is disposed within the conductor pipe 10 a sufficient distance to prevent junking of the drilling equipment in the event of a pressure loss within the conductor pipe 10 which causes the cement to U-tube or move up into the conductor pipe 10.

With the drill string 18 retracted, the cement 40 is pumped through the drill string 18 and forced upwardly into the outer annulus of the conductor pipe 10 while pressure is maintained within the conductor pipe 10 to prevent the cement 40 from travelling up the conductor pipe 10. A sufficient amount of cement 40 is pumped to set the lower end of the conductor pipe 10, fill the outer annulus, and cover the foot pad 16 of the conductor pipe 10. In this manner, the conductor pipe assembly will be fully set to prevent movement thereof.

Figure 4:
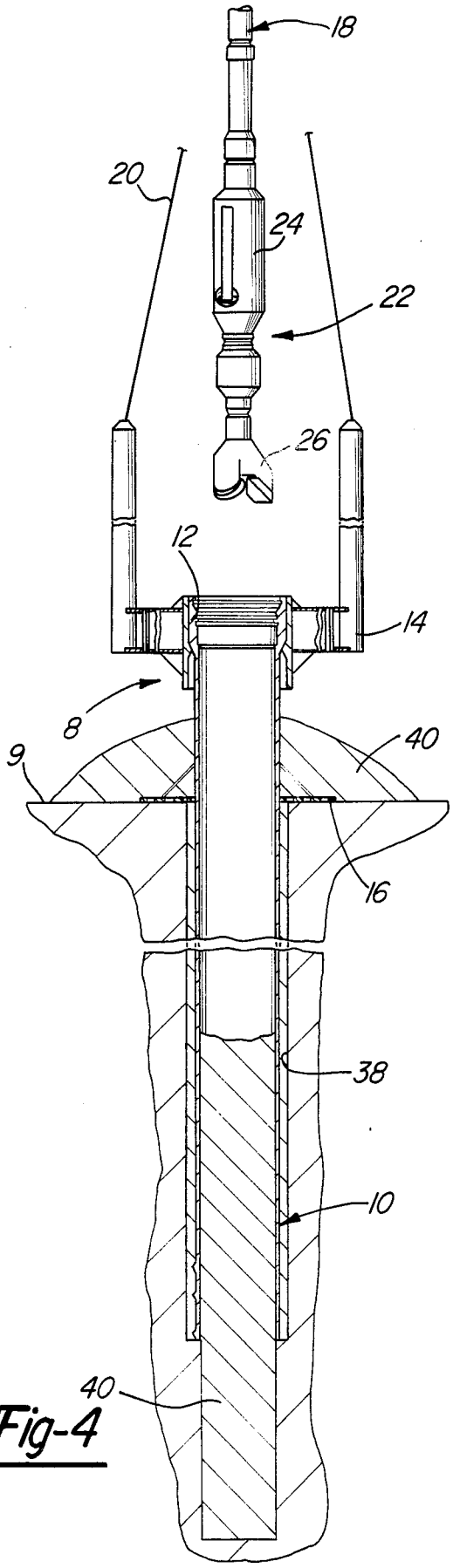
FIG. 4 is another similar view illustrating the disconnection of the housing latch and recovery of the drill string.

Referring now to FIG. 4, once the cement 40 has hardened thereby setting the conductor pipe assembly 8, the housing latch 32 may be detached from the wellhead housing 12 of the conductor pipe 10. Thereafter, as the drill string 18 is raised the housing latch 32 and drill string 18 will be removed from the conductor pipe 10 leaving the set conductor pipe 10. In this manner, the drill string 18, including the drill portion 22 is retrieved while the conductor pipe 10 and guide base 14 are set within the ocean floor 9 so that drilling operations may be commenced through the conductor pipe assembly 8 in the usual manner. The guide base 14 remains connected to the surface vessel by way of guidelines 20 so that a drill string for subsequent drilling may be guided into the conductor pipe 10.

Figure 5:
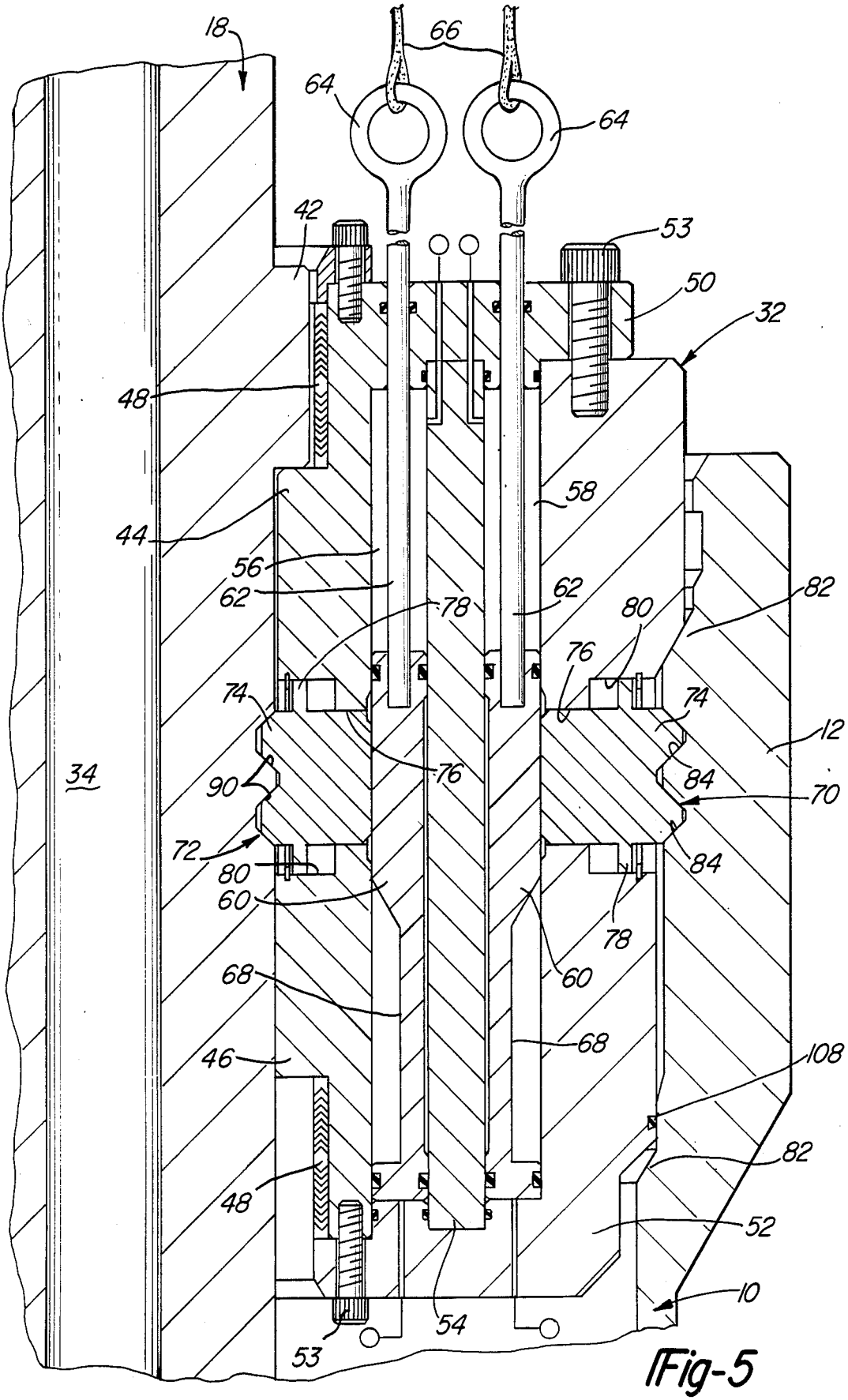
FIG. 5 is a partial sectional view of the housing latch within the conductor pipe and engaging the upper latch sub of the drill string.
Figure 6:
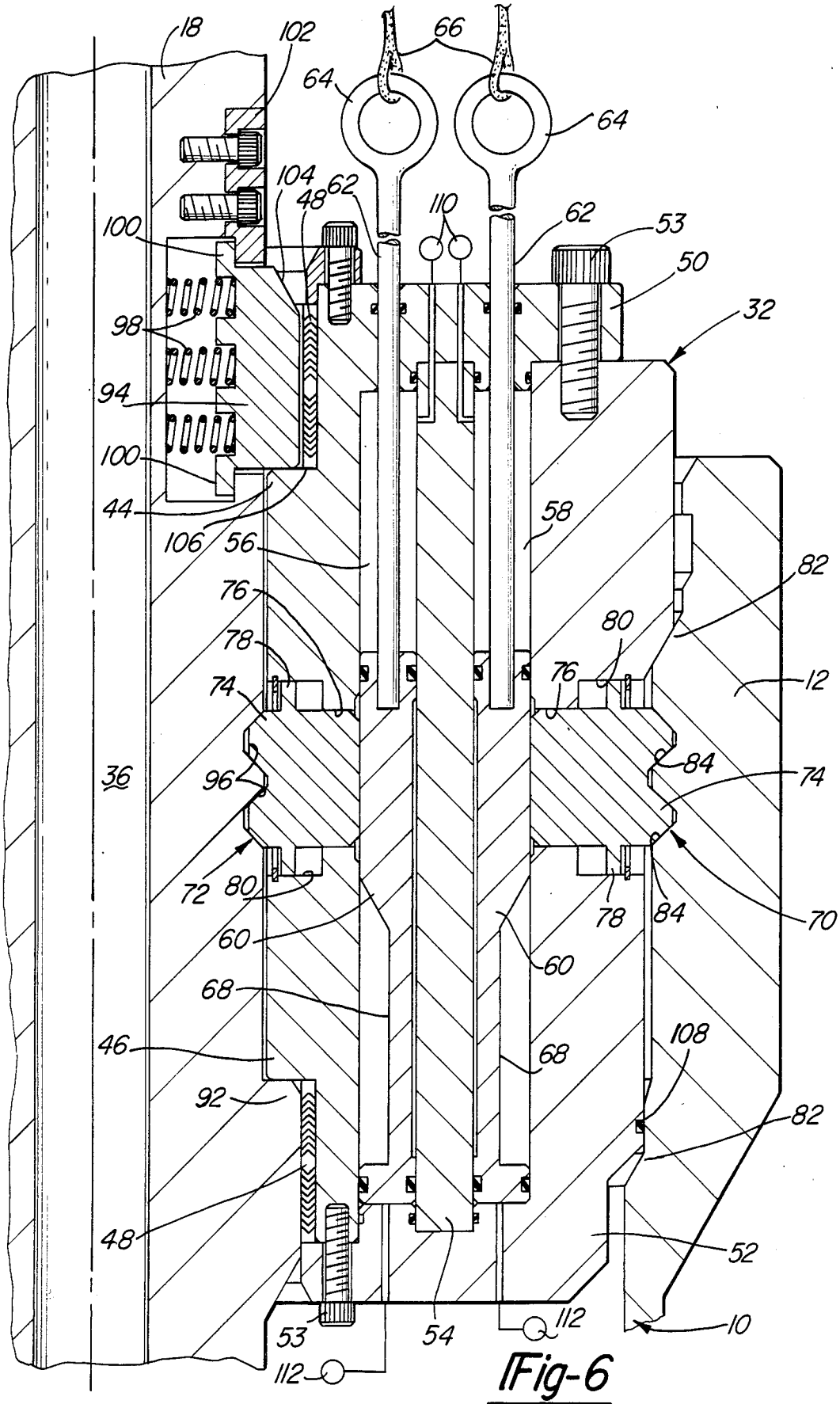
FIG. 6 is a partial sectional view of the housing latch engaging the lower latch sub of the drill string.

As shown in FIG. 5 and FIG. 6, the housing latch 32 positionally secures the drill string 18 in relation to the wellhead housing 12. In FIG. 5, the housing latch 32 engages the upper latch sub 34 which includes an annular shoulder 42 to support the drill string 18 within the housing latch 32. The annular shoulder 42 engages a similar shoulder 44 formed in the housing latch 32 to prevent the drill string 18 from moving downwardly in relation to the housing latch 32. The housing latch 32 also includes a lower shoulder 46 which cooperates with the lower latch sub 36 as will be subsequently described, Both shoulders 44 and 46 of the housing latch 32 include seals 48 which prevent pressure loss between the drill string 18 and the housing latch 32 during the drilling process and the subsequent cementation of the conductor pipe in order to prevent U-tubing of the cement.

Referring now to FIGS. 5 and 6, the housing latch 32 is preferably constructed of an upper latch body 50 and a lower latch body 52 secured together by a series of bolts 53. Disposed within the housing latch 32 and extending between the upper body 50 and lower body 52 is at least one divider 54 which forms an inner hydraulic cylinder 56 and an outer hydraulic cylinder 58. In a preferred embodiment, sets of inner and outer cylinders are circumferentially located in the housing latch 32 so as to provide an even distribution of the force exerted upon the housing latch 32. Disposed within each of the cylinders is a piston 60 having a piston rod 62 extending upwardly therefrom through the top of the housing latch 32. Formed at the upper end of each piston rod 62 is an eyelet-hook 64 having a manual control cable 66 secured thereto. The pistons 60 may be any shape which conforms to the configuration of the cylinder 56 or 58 while allowing reciprocal movement within the respective cylinder. In addition, each of the pistons 60 include removed portions 68 which cooperate with retractable pin means.

In order to detachably secure the housing latch 32 to both the wellhead housing 12 and the drill string 18, outwardly extending retractable pin means 70 and inwardly extending retractable pin means 72 are disposed within the housing latch 32. The retractable pin means 70 and 72 include a dual-headed pin 74 disposed within a throughbore 76 formed in the latch wall. The pin 74 includes a flange 78 which travels within the slot 80. The opposite end of the pin 74 abuts against the piston 60 which holds the pin 74 in its extended position. However, as the piston 60 is moved upwardly, as will be subsequently described, the pin 74 is exposed to the removed portion 68 of the piston 60 allowing the pin 74 to retract within the throughbore 76.

The housing latch 32 is supported within the wellhead housing 12 by a series of annular shoulders 82 formed in the housing 12. In addition, the wellhead housing 12 is provided with a pair of annular grooves 84 which cooperate with the outwardly extending retractable pin means 70 to lockingly secure the housing latch 32 within the wellhead housing 12. In order to assemble the structure, the dual-head pin 74 of the pin means 70 is retracted and the housing latch 32 is placed within the wellhead housing 12 until it comes to rest on the shoulder 82. With the latch 32 seated, the pin means 70 can be moved outwardly into engagement with the corresponding grooves 84. This is accomplished by moving the outer piston 60 downwardly such that the pin 74 contacts the enlarged portion of the piston thereby forcing the pin 74 outwardly into the grooves 84.

In a similar manner, the housing latch 32 engages the drill string 18 to lockingly secure it either in its extended or retracted position. Referring first to FIG. 5, the upper latch sub 34 includes a pair of annular grooves 90 formed below the shoulder 42 of the sub 34. These grooves 90 are adapted to receive the heads of the inwardly extending pin means 72. The upper latch sub 34 is designed so that with the shoulder 42 resting on the shoulder 44 of the housing latch 32 the pin means 72 engage the grooves 90. In order to retract the drill string 18 from this extended position, the pin means 72 are released by moving the inner piston 60 upwardly until the pin 74 is able to retract into the removed portion 68 of the piston. With the inwardly extending pin means 72 released (outer pin means 70 remain locked) the drill string 18 can be drawn upward forcing the pin 74 to retract into the removed portion 68 of the piston 60.

Referring now to FIG. 6, the drill string 18 is drawn upwardly until the lower latch sub 36 comes into contact with the housing latch 32. The lower latch sub 36 includes a lower annular shoulder 92 formed near the bottom of the latch sub 36, a series of outwardly biased dogs 94 provided at the upper end of the sub 36, and a pair of annular grooves 96 intermediate the shoulder 92 and the dogs 94. The dogs 94 are seated within the upper latch sub 36 and are biased outwardly by springs 98 disposed between the dog 94 and the wall of the latch sub 36. Flange portions 100 maintain the dogs 94 within the latch sub 36 while removable plate 102 allows the dogs 94 to be removed for replacement or cleaning. The dogs 94 include a sloped upper edge 104, which allows the dogs 94 to pass beneath the housing latch 32, and a square lower edge 106 which acts as a shoulder in order to support the weight of the drill string 18 in the retracted position.

Referring again to the method of the present invention, once the pin means 72 are retracted to release upper latch sub 34, the drill string 18 will be drawn upwardly to retract the drill portion 22. As the sloped edge 104 of the dogs 94 engages the lower end of the housing latch 32, the dogs 94 are forced inwardly to permit further retraction of the drill string. Retraction continues until the lower shoulder 92 of the latch sub 36 engages the shoulder 46 of the housing latch 32. Simultaneously, the dogs 94 pass over the upper shoulder 44 of the housing latch 32 and are forced outwardly by the springs 98. In this position, the shoulder 92 is in sealing engagement with the seal 48 of the housing latch 32 thereby preventing pressure loss within the conductor pipe 10 during cementation.

Once the drill string 18 is fully retracted and the lower latch sub 36 is positioned within the housing latch 32 as shown in FIG. 6, the drill string 18 can be lockingly secured by extending the pin means 72 into the grooves 96 of the latch sub 36. This is accomplished by moving the inner piston 60 downwardly until the enlarged portion thereof forces the pin 74 to engage the grooves 96.

Retraction of the piston means 70 and 72 is controlled by the hydraulic piston and cylinder assemblies disposed within the housing latch 32. Each of the cylinders 56 and 58 are connected to a pair of hydraulic fluid supplies controlled from the surface vessel. Connected to the top of the cylinders are hydraulic supplies 110 which control the volume of hydraulic fluid above the piston 60 within the cylinder. Similarly, hydraulic supplies 112 control the volume of hydraulic fluid below the piston 60. By varying the fluid volumes above and below the piston 60 the movement thereof can be controlled so as to permit the pin means 70 and 72 to retract or engage. Thus, in order to move the piston 60 upwardly, the hydraulic pressure is decreased by supply 110 while hydraulic pressure is increased by supply 112. Conversely, to move the piston 60 downwardly in order to force the pin 74 into engagement, hydraulic pressure is decreased by supply 112 while supply 110 increases the hydraulic pressure. The pistons 60 are also provided with manual overrides which allow the pistons 60 to be moved upwardly in order to disengage the pins 74 in the event the hydraulic supplies 110 and 112 fail. The eyelet hooks 64 formed at the ends of the piston rods 62 are connected to override cables 66 which extend to the surface vessel. In the event of a hydraulic malfunction, the pistons 60 may be drawn upwardly by way of the cables 66 thereby permitting release of the pin means 70 and 72.

With the drill string 18 retracted as shown in FIGS. 3 and 6, cementation of the conductor pipe 10 may be completed. The seals 48 and 108 maintain the necessary pressure within the conductor pipe 10 to prevent U-tubing of the cement. Once the cement has set, the drill string 18 and latch housing 32 can be recovered for future operations by disengaging the outer pin means 70 and drawing the drill string 18 upwardly. As the assembly is raised the housing latch 32 will be supported on the fixed anular shoulder 92 of the lower latch sub 36.

Thus, the present invention provides a method and apparatus for setting a conductor pipe assembly within the ocean floor while permitting retrieval of the work string. The housing latch 32 allows hydraulic or manual control to adjustably retract the drill string or disengagement of the entire assembly for retrieval. Moreover, seals are provided which cooperate with fixed structures of the drill string and wellhead housing to withstand extreme pressures during the cementing process.

The foregoing detailed description has been given for clearness of understanding only and no unnecessary limitations should be understood therefrom as some modifications will be obvious to those skilled in the art without departing from the scope and spirit of the appended claims.

We claim:

1. An underwater conductor pipe drilling system comprising:

a conductor pipe having a head housing at the upper end thereof;

a drill string coaxially disposed within said conductor pipe, said drill string having formation cutting means on the lower end thereof, a lower latch sub disposed above said formation cutting means, and an upper latch sub disposed above said lower latch sub; and an annular housing latch detachably connected to said head housing of said conductor pipe and having said drill string extending therethrough, said housing latch including outer means for detachably securing said housing latch within said head housing for said conductor pipe such that said drill string and said housing latch may be selectively removed from said conductor pipe and inner means for adjustably securing said drill string within said housing latch such that said drill string may be selectively adjusted from an extended postion with said formation cutting means extending below the lower end of said conductor pipe wherein said housing latch engages said upper latch sub to a retracted position with said formation cutting means disposed within said conductor pipe wherein said housing latch engages said lower latch sub;

said outer means for detachably securing said housing latch to said head housing of said conductor pipe including outer retractable pin means extending radially outward from said housing latch to selectively engage said head housing; and said inner means for adjustably securing said drill string within said housing latch including inner retractable pin means extending radially inwardly from said housing latch to selectively engage said upper and lower latch subs of said drill string.

2. The drilling system as defined in claim 1 wherein said outer retractable pin means is selectively extended and retracted by a first hydraulic piston and cylinder assembly, said first piston and cylinder assembly including means for manual override to retract said outer pin means.

3. The drilling system as defined in claim 2 wherein said inner retractable pin means is selectively extended and retracted by a second hydraulic piston and cylinder assembly, said second piston and cylinder assembly including means for manual override to retract said inner pin means.

4. The drilling system as defined in claim 3 wherein said first and second piston and cylinder assemblies are concentrically disposed within said annular housing latch such that said inner retractable pin means engages said drill string within said head housing of said conductor pipe.

5. The drilling system as defined in claim 3 wherein said drill string further comprises:

a plurality of tubular drill sections, said formation cutting means being secured to the lower end of said sections and including a drill bit at the lower end thereof and an expansible underreamer secured to said sections above said drill bit; and means for rotating said drill bit and underreamer disposed above said underreamer and below said lower latch sub.

6. The drilling system as defined in claim 4 wherein said upper latch sub includes an annular shoulder and at least one annular groove disposed axially below said shoulder, said groove cooperating with a corresponding inwardly extending pin means of said housing latch to selectively secure said upper latch sub within said housing latch thereby selectively securing said drill string in said extended position.

7. The drilling system as defined in claim 6 wherein said lower latch sub includes an annular shoulder and a plurality of retractable dogs adapted to facilitate engagement of said lower latch sub with said housing latch, said retractable dogs disposed axially above said annular shoulder.

8. The drilling system as defined in claim 7 wherein said lower latch sub includes at least one annular groove intermediate said annular shoulder and said retractable dogs, said groove cooperating with a corresponding inwardly extending pin means of said housing latch to lockingly secure said lower latch sub within said housing latch thereby selectively securing said drill string in said retracted position.

9. The drilling system as defined in claim 7 wherein said housing latch includes upper and lower inner annular shoulders, said annular shoulders having seal means.

10. The drilling system as defined in claim 9 wherein said upper annular shoulder receives said annular shoulder of said upper latch sub when said drill string is in said extended position and engages said retractable dogs of said lower latch sub when said drill string is in said retracted position.

11. The drilling system as defined in claim 10 wherein said lower annular shoulder of said housing latch receives said annular shoulder of said lower latch sub when said drill string is in said retracted position, said seal means of said housing latch sealingly engaging said annular shoulder of said lower latch sub.

12. An underwater conductor pipe drilling system comprising:

a conductor pipe having a head housing formed at the upper end thereof;

a drill string disposed within said conductor pipe, said drill strng having a drill bit and underreamer on the lower end thereof, means for rotating said drill bit and underreamer, a lower latch sub disposed above said rotating means, and an upper latch sub axially spaced above said lower latch sub;

an annular housing latch releasably mounted within said head housing of said conductor pipe and having said drill string adjustably extending therethrough, said housing latch including outer retractable pin means for releasably securing said housing within said head housing of said conductor pipe such that said drill string and said housing latch may be selectively released from said conductor pipe and inner retractable pin means for adjustably securing said drill string within said housing latch such that said drill string may be selectively adjusted from an extended position with said drill bit and underreamer extending below the lower end of said conductor pipe wherein said housing latch engages said upper latch sub to a retracted position with said drill bit and underreamer disposed within said conductor pipe wherein said housing latch engages said lower latch sub;

said outer retractable pin means for releasably securing said housing latch to said head housing including at least one outer release pin selectively extendable radially outwardly from said housing latch to releasably engage said head housing; and said inner retractable pin means for adjustably securing said drill string within said housing latch including at least one inner release pin selectively extendable radially inwardly from said housing latch to selectively engage said upper latch sub and said lower latch sub of said drill string.

13. The drilling system as defined in claim 12 wherein said outer release pin of said outer retractable pin means is selectively extended and retracted by a first hydraulic piston and cylinder assembly and wherein said inner release pin of said inner retractable pin means is selectively extended and retracted by a second hydraulic piston and cylinder assembly, said piston and cylinder assemblies being concentrically disposed within said annular housing latch.

14. The drilling system as defined in claim 13 wherein said first and second piston and cylinder assemblies include means for manual override to retract said pin means.

15. The drilling system as defined in claim 12 wherein said upper latch sub includes an annular shoulder and at least one annular groove disposed axially below said shoulder, said annular shoulder engaging the top of said housing latch to support said drill string within said housing latch and said groove cooperating with a corresponding inwardly extending release pin to selectively secure said upper latch sub within said housing latch thereby selectively securing said drill string in said extended position.

16. The drilling system as defined in claim 15 wherein said lower latch sub includes an annular shoulder, a plurality of retractable dogs disposed axially above said annular shoulder, and at least one annular groove disposed intermediate said shoulder and said dogs, said dogs cooperating with the top of said housing latch to prevent subsequent extension of said drill string, said groove cooperating with a corresponding inwardly extending release pin to selectively secure said lower latch sub within said housing latch thereby securing said drill string in said retracted position, and said annular shoulder cooperating with the bottom of the housing latch to support said housing latch during extraction of said drill string and housing latch from said conductor pipe.

17. The drilling system as defined in claim 36 wherein said housing latch includes inner seal means which sealingly engage said upper latch sub and said lower latch sub.

18. The drilling system as defined in claim 12 and further comprising a guide base fixedly secured to the upper end of said conductor pipe.

19. A method for setting an underwater conductor pipe system comprising the steps of:

positioning a conductor pipe in surrounding relation to a portion of a drill string with the formation cutting means on the lower end of said drill string extending below the bottom of said conductor pipe, said conductor pipe supported from an upper latch sub disposed within said drill string, said conductor pipe connected to said drill string by a housing latch selectively detachably connected to the upper end of said conductor pipe, said housing latch selectively engaging said upper latch sub of said drill string;

lowering said drill string with said conductor pipe thereon in a body of water;

activating said formation cutting means of said drill string to drill a hole in the earth at the bottom of the body of water so that as the hole is drilled and said drill string is lowered, said conductor pipe is lowered into the hole;

releasing the connection between said housing latch and said upper latch sub of said drill string;

raising said drill string relative to said housing latch and conductor pipe until a lower latch sub disposed within said drill string intermediate said formation cutting means and said upper latch sub lockingly seats within said housing latch thereby retracting said formation cutting means into said conductor pipe and sealing between said drill string and said conductor pipe;

cementing around the exterior of said conductor pipe in the drilled hole;

releasing the connection between said housing latch and said conductor pipe; and recovering said drill string with said formation cutting means by extracting said drill string and said housing latch from said conductor pipe.

20. A method for setting an underwater conductor pipe system comprising the steps of:

positioning a conductor pipe having a head housing at the upper end thereof in surrounding relation to a portion of a drill string with formation cutting means on the lower end of said drill string extending below the bottom end of said conductor pipe, said conductor pipe having an annular housing latch detachably disposed within said head housing of said conductor pipe, said housing latch selectively detachably connected to an upper latch sub disposed within said drill string wherein said annular housing latch is selectively detachably connected to said head housing of said conductor pipe by outer retractable pin means of said housing latch and said annular housing latch is selectively detachably connected to said upper latch sub of said drill string by inner retractable pin means of said housing latch;

lowering said drill string with said conductor pipe thereon in a body of water;

activating said formation cutting means of said drill string to drill a hole in the earth at the bottom of the body of water so that as the hole is drilled and said drill string is lowered, said conductor pipe is lowered into the hole until a guide base fixedly secured to the upper end of said conductor pipe engages the bottom of the body of water;

retracting said inner pin means of said housing latch to detach said upper latch sub of said drill string from said housing latch;

raising said drill string relative to said housing latch and conductor pipe until a lower latch sub disposed within said drill string intermediate said formation cutting means and said upper latch sub lockingly seats within said housing latch thereby retracting said formation cutting means into said conductor pipe, said lower latch sub including retractable dogs and an annular shoulder adapted to engage said housing latch, said inner pin means being extended to lockingly engage said lower latch sub within said housing latch;

cementing around the exterior of said conductor pipe in the drilled hole;

retracting said outer pin means of said housing latch to release said housing latch from said head housing of said conductor pipe; and recovering said drill string with said formation cutting means by extracting said drill string and said housing latch from said conductor pipe.

* * * * *